US005458769A

United States Patent [19]

Johannessen

[11] Patent Number: 5,458,769

[45] Date of Patent: Oct. 17, 1995

[54] FLOOR DRAIN

[76] Inventor: Jørgen M. Johannessen, 6 Aspevej, Strøby Egede, DK-4600 Køge, Denmark

[21] Appl. No.: 235,154

[22] Filed: Apr. 28, 1994

Related U.S. Application Data

[63] Continuation of Ser. No. 910,342, filed as PCT/DK91/00019 Jan. 27,1992, abandoned.

[30] Foreign Application Priority Data

Jan. 24, 1990 [DK] Denmark ..... 188/90

[51] Int. Cl.[6] ..... E03F 5/04

[52] U.S. Cl. ..... 210/163; 210/164; 210/165; 210/166; 52/12; 4/292; 4/293; 4/650; 4/652; 4/673; 4/683

[58] Field of Search ..... 210/163, 164, 210/165, 166; 52/12, 302; 4/290, 292, 293, 613, 650, 651, 652, 653, 673, 674, 683

[56] References Cited

U.S. PATENT DOCUMENTS

| | | | |
|---|---|---|---|
| 674,294 | 5/1901 | Cox | 4/291 |
| 780,572 | 1/1905 | McQuistion | 210/164 |
| 989,559 | 4/1911 | Bohn . | |
| 1,109,740 | 9/1914 | Dehn . | |
| 1,450,629 | 4/1923 | Grigg | 4/292 |
| 1,469,790 | 10/1923 | Hysko | 210/164 |
| 1,507,531 | 9/1924 | Vaudell | 210/164 |
| 1,681,117 | 8/1928 | Howcott | 210/164 |
| 1,686,415 | 10/1928 | Lyes | 210/164 |
| 1,751,877 | 3/1930 | Nance | 210/164 |
| 1,973,304 | 9/1934 | Boosey . | |
| 2,101,978 | 12/1937 | Boosey | 210/165 |
| 2,136,945 | 11/1938 | Klein | 210/164 |
| 2,270,253 | 1/1942 | Boosey | 210/164 |
| 2,731,649 | 1/1956 | Valentine | 4/286 |
| 3,042,210 | 7/1962 | Hattori | 210/163 |
| 3,516,541 | 6/1970 | Hardingham | 210/164 |
| 3,556,993 | 1/1971 | Persson | 210/164 |
| 4,045,346 | 8/1977 | Swaskey | 210/164 |
| 4,263,138 | 4/1981 | Kessel | 210/163 |
| 4,275,760 | 6/1981 | Kessel | 4/288 |
| 4,463,461 | 8/1984 | Van den Broeke | 4/288 |
| 4,560,302 | 12/1985 | Karbstein . | |
| 4,682,907 | 7/1987 | Gaudin | 210/164 |
| 4,706,306 | 11/1987 | Smith | 4/290 |
| 4,776,722 | 10/1988 | Gaudin | 210/164 |
| 4,908,883 | 3/1990 | Rivera | 4/287 |
| 5,005,603 | 4/1991 | Amundson | 4/289 |
| 5,028,320 | 7/1991 | Gaudin | 210/164 |
| 5,062,735 | 11/1991 | Gaudin | 210/164 |
| 5,124,031 | 6/1992 | Dallmer | 210/164 |

FOREIGN PATENT DOCUMENTS

| | | | |
|---|---|---|---|
| 217466 | 10/1957 | Australia | 210/164 |
| 120316 | 9/1968 | Denmark . | |
| 11154 | 5/1980 | European Pat. Off. | 210/166 |
| 176683 | 4/1986 | European Pat. Off. . | |
| 436093 | 7/1991 | European Pat. Off. | 4/613 |
| 1162778 | 2/1964 | Germany | 210/164 |
| 1163256 | 2/1966 | Germany . | |
| 1934352 | 2/1970 | Germany . | |
| 2803959 | 8/1979 | Germany | 210/164 |
| 2808711 | 9/1979 | Germany | 210/166 |
| 2941660 | 4/1981 | Germany | 210/164 |
| 215355 | 11/1984 | Germany | 210/164 |
| 3708543 | 9/1988 | Germany | 4/286 |
| 327806 | 8/1970 | Sweden . | |
| 369075 | 6/1963 | Switzerland | 210/164 |
| 433135 | 9/1967 | Switzerland . | |
| 1326713 | 7/1987 | U.S.S.R. | 4/292 |
| 2070093 | 9/1981 | United Kingdom | 210/166 |

*Primary Examiner*—Thomas M. Lithgow
*Attorney, Agent, or Firm*—Browdy and Neimark

[57] ABSTRACT

The floor drain comprises a drainage bowl (2) or outlet gutter with an upward facing inlet opening (4) and an outlet (5), comprises slots (9) or passageways having each a substantially vertical portion with a constant cross-section, and having each its entrance on a level with the inlet opening (4) and extends somewhat downwards and is adapted to be running to capacity by drainage of water from a floor.

12 Claims, 13 Drawing Sheets

FLOOR DRAIN

This application is a continuation of application Ser. No. 07/910,342, filed Jul. 24, 1992 now abandoned.

BACKGROUND OF THE INVENTION

Field of the Invention

The invention relates to a floor drain comprising a drainage bowl or outlet gutter with an upward facing inlet opening and an outlet.

Drains of this type are widely known.

DK patent No. 120 316 deals with a roof drain in which a device for preventing vortex formation at the outlet is disposed above the outlet. The discharge pipe will then run to capacity, thereby obtaining a suction effect.

The disclosure of U.S. Pat. No. 1,973,304 deals with a drain including a grating which in respect of traffic strength has a large thickness.

DE patent No. 32 17 001 relates to another grating for an outlet gutter serving as transverse drainage of a roadway. The grating therefore has a large thickness with the view of obtaining a great strength. The perforations of the grating have the shape of elongated slots converging upwards to obtain the greatest possible strength on the level of the roadway.

SUMMARY OF THE INVENTION

The object of the invention is to provide a floor drain with suction effect.

A further purpose of the invention is to provide a drain standing up to great traffic strength in relation to capacity and prime costs.

A further object of the invention is to provide a hygienic floor drain.

The floor drain according to the invention differs from the prior art in comprising slots or passageways each of which has a substantially vertical portion with constant cross-section, has the entrance on a level with the inlet opening and extends a distance downwards, the passage from the entrance to the vertical portion comprising no restrictions constituted by parts with cross sectional areas substantially smaller than that of the vertical portion. The floor drain will when running to capacity have its slots or passageways filled whereby a suction effect is obtained increasing the capacity of the drain in relation to its size. A drain according to the invention may therefore be designed with smaller dimensions than a corresponding conventional drain with the same capacity, thereby providing for the same traffic strength with smaller gauges of material.

In an embodiment of the invention the slots or passageways are defined by the side walls of the drainage bowl or outlet gutter and by an internal member received therein. The internal member is preferably located centrally in relation to the inlet opening. By using only the slots or the passageways as inlets a small sluiced surface that is a hygienic advantage is obtained in relation to a drain with grating.

In a further embodiment of the invention the inner side walls of the drainage bowl or outlet gutter extend from the inlet opening vertically downwards, the inner member is made from sheet material and has a central portion and vertically extending side edges, and the slots or the passageways are positioned between the internal, vertical side walls of the drainage bowl or the outlet gutter and the vertical side edges of the internal member. This design provides for obtaining that the floor drain may be made from stainless sheet steel which due to the above comparatively great strength in relation to the gauge of material will be relatively easy to shape, for instance to pull out by means of a hydraulic press.

In a further embodiment of the invention the side walls of the drainage bowl or outlet gutter have an inward projecting shoulder, the vertical sections of the slots or the passageways extend below said shoulder and the inner member has an upper plane portion on a level with the inlet opening, extending above the vertical sections of the slots or passageways towards the periphery of the inlet opening and a central portion. A drain is thus obtained with an external rabbet at the inlet opening which may be advantageous upon mounting.

The central portion may optionally include one or more continuous openings, for instance catching holes or grating holes. So the drain is given extra capacity in case of peak loadings.

In a supplementary embodiment of the invention the inner side walls of the drainage bowl extend to a bottom, the outlet is provided in an elevation at the bottom and the side edges of the inner member extend downwards below the level of the outlet. It is thus obtained that the drain per se has the effect of a water seal.

In a first development of the latter embodiment the side walls of the drainage bowl are constituted by a tube section united with another similar tube section at an angle of more than 90° and the axes of said two tube sections intersect in the vicinity of the plane of the bottom. This provides for obtaining a drain with a lateral outlet and a very small height of installation.

In a second development the drain is the entrance to a sluice well or a pump well.

In a third development the area of the outlet is substantially smaller than the area of the inlet opening, and at a distance from the elevation there is a wall surrounding said elevation and extending from the same lower level as the side edges of the inner member and to a level above the level of the outlet, thereby catering for passage above said surrounding wall. It is then obtained that the floor drain may be used as a vacuum valve without loosing its water seal.

In a further embodiment of the invention the inner member extends upwards above the level of the inlet opening, said member having a vertical continuous opening on opposite side of the side walls forming the slots or passageways in relation to said slots or passageways, and the inner member has a top portion extending beyond the inlet opening. This embodiment provides for obtaining a floor drain through the centre of which a sewage pipe may be passed down, e.g. from a sink.

BRIEF DESCRIPTION OF THE DRAWINGS

The invention will now be explained in detail with reference to the schematical drawings, in which.

DESCRIPTION OF THE PREFERRED EMBODIMENTS

Figure 1:
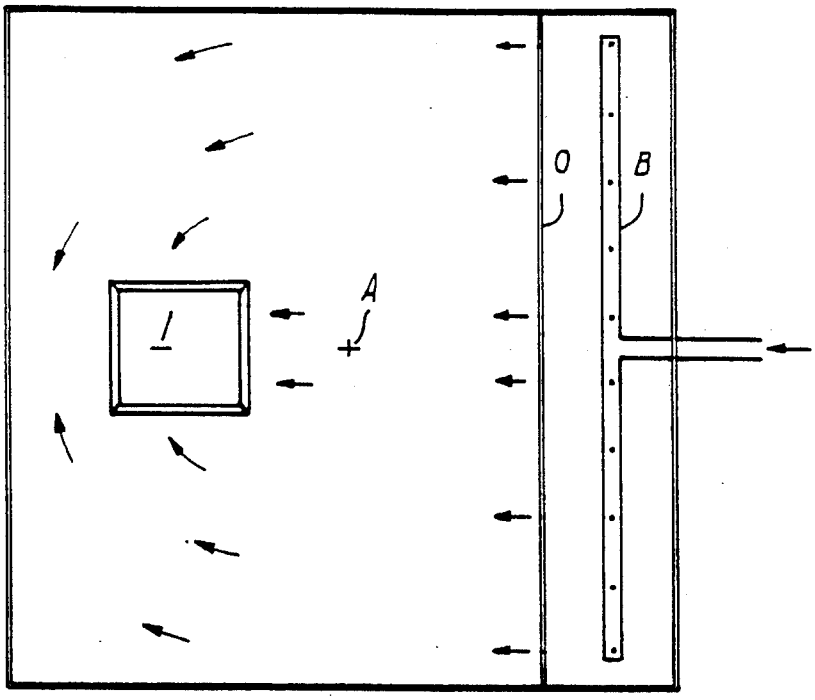
FIG. 1 illustrates a test setup for measuring the capacity of a floor drain.

FIG. 1 illustrates the testing of a floor drain with the view of determining its capacity. Water flows from an inlet pipe B over an edge O in order to flow on a broad front towards the drain 1 as shown by arrows. The supply of water through inlet pipe B is controlled so that the height of water above the floor at a point A amounts to 20 mm. The supplied stationary flow of water through inlet pipe B is designated as the capacity of the drain.

Figure 2:
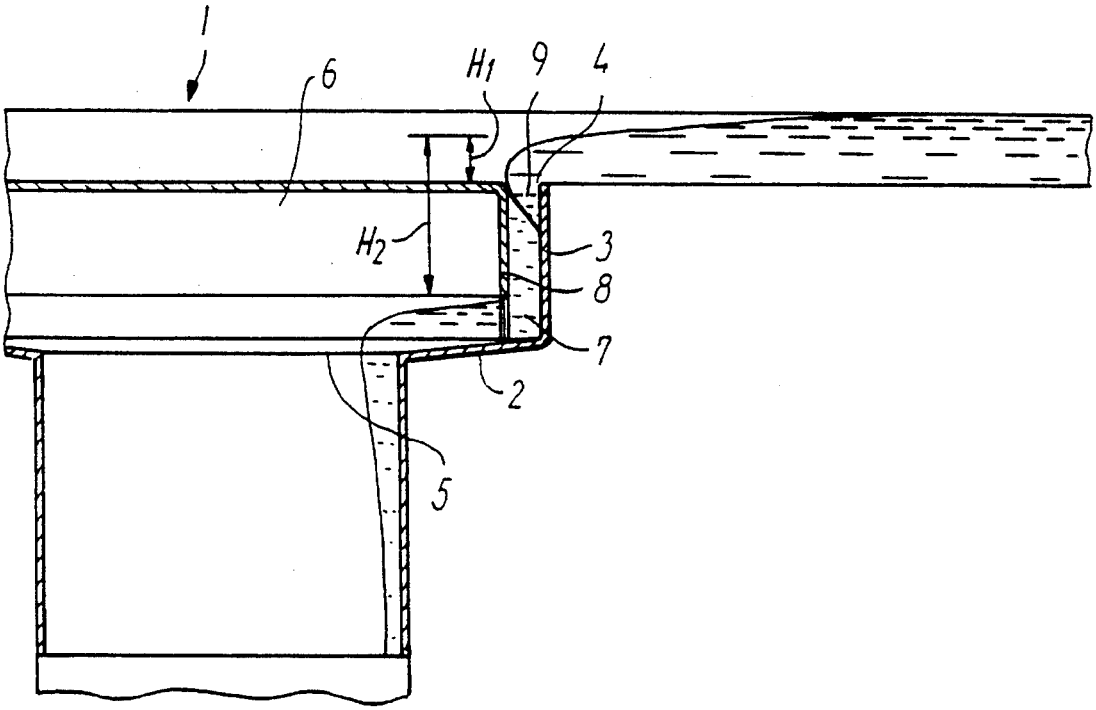
FIG. 2 is a sketch illustrating the suction effect of a floor drain according to the invention.

FIG. 2 shows a drain 1 according to the invention in the above described test setup. Drain 1 includes a drainage bowl 2 with vertical side walls 3 extending downwards from the inlet opening 4 of drainage bowl 2. Drainage bowl 2 has an outlet 5. Drainage bowl 2 accommodates a member or a bell 6 which by means of legs or spacers 7 is placed so as to form between the vertical side wall 3 and a vertical side wall 8 of bell 6 a slot 9 having its entrance on a level with inlet opening 4.

In a conventional drain the water would be passed down into the drain at a pressure head H1, as shown in FIG. 2. When slot 9 runs to capacity, a pressure head H2 in the drain according to the invention will, however, be obtained which is several times higher than H1 and which is the height from the lower edge of the vertical side edge 8 of bell 6 to the water surface above slot 9. In view of the fact that the atmospheric pressure reigns at the lower edge of bell 6 there is thus a negative pressure at the orifice of the slot corresponding to the head H2-H1 and the drain therefore has a suction effect.

Figure 4:
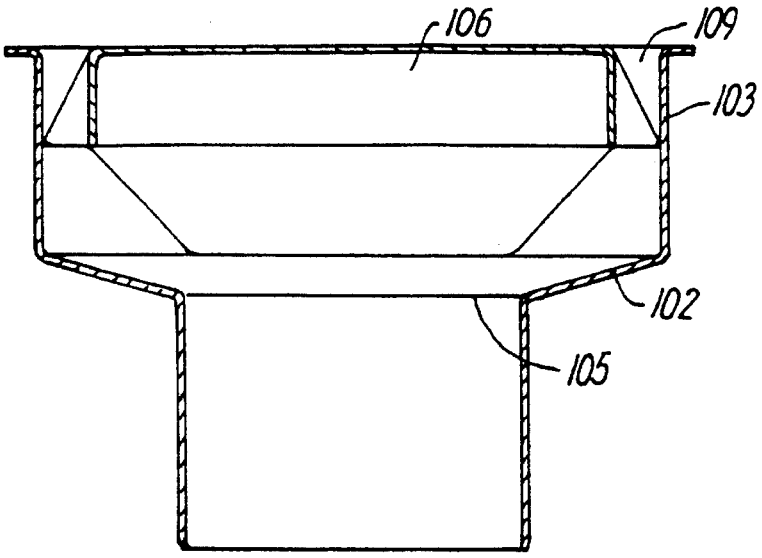
FIGS. 4 and 5 are sections of the first embodiment along the lines IV—IV and V—V, respectively, in FIG. 3, FIGS. 6 and 7 a second embodiment, viewed from above and in a vertical section, respectively, FIGS. 8 and 9 a third embodiment, viewed from above and in a vertical section, respectively, FIGS. 10 and 11 a fourth embodiment, viewed from above and in a vertical section, respectively, FIGS. 12 and 13 a fifth embodiment, viewed from above and in a vertical section, respectively, FIGS. 14 and 15 a sixth embodiment, viewed from above and in a vertical section, respectively, FIGS. 16 and 17 a seventh embodiment, viewed from above and in a vertical section, respectively, FIGS. 18 and 19 an eighth embodiment, viewed from above and in a vertical section, respectively, FIGS. 20 and 21 a ninth embodiment, viewed from above and in a vertical section, respectively, FIGS. 22 and 23 a tenth embodiment, viewed from above and in a vertical section.
Figure 5:
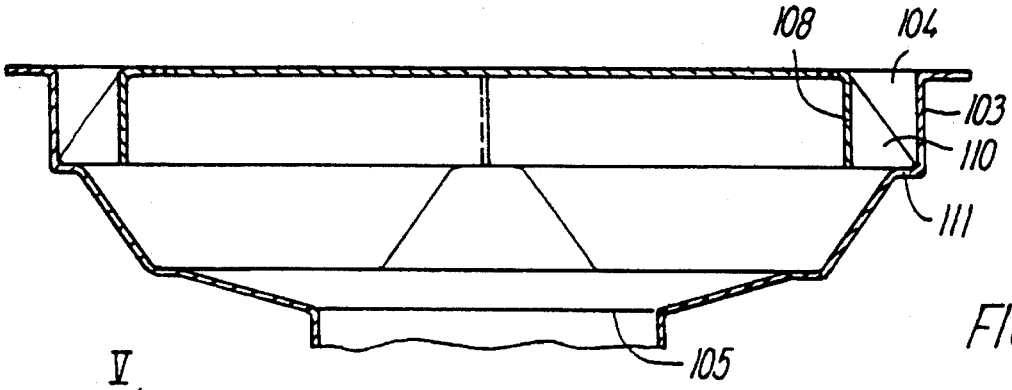
Figure 3:
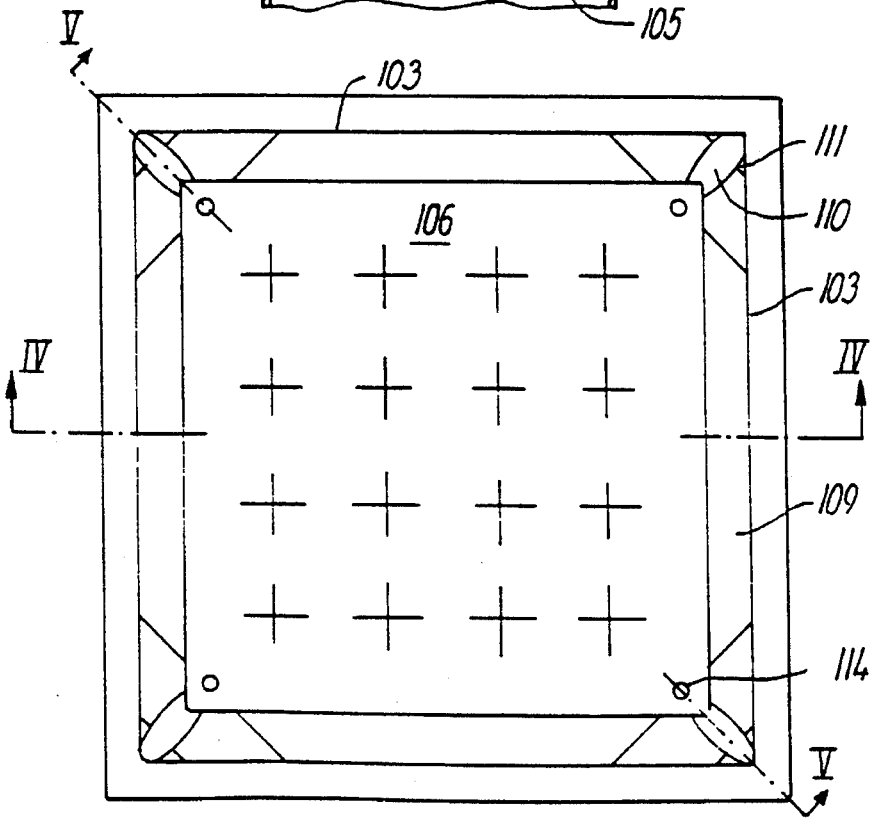
FIG. 3 is a first embodiment of the invention, viewed from above.

FIGS. 3 to 5 illustrate a first proper embodiment of a drain according to the invention. A slot 109 is here formed between vertical side walls 103 of a drainage bowl 102 and vertical side walls 108 of a bell 106 made from stainless sheet steel whose ends are bent down to constitute the vertical side walls 108. A tongue 110 thus occurs in each corner of bell 106. Said tongues operate as legs and as spacers, respectively. Drainage bowl 102 has an outlet 105 and is drawn out of stainless sheet steel and shoulders 111 are provided at the corners on which the lower edges of tongues 110 are supported in order to keep the surface of bell 106 on a level with the inlet opening 104 of drainage bowl 102.

This embodiment offers a very simple drain that is easy and inexpensive to manufacture from sheet material and which by virtue of the suction effect in slot 109 may be given relatively small outer dimensions, thereby obtaining a comparatively good strength in relation to capacity. Moreover, the drain of this embodiment has a comparatively small sluiced surface and comparatively few corners and hooks together with a smooth surface, factors making the drain more hygienic.

The drain according to the invention may for instance in this first embodiment be followed in the drainage direction by a pocket trap, a P-trap, a lateral outlet, a strainer basket, a sludge bucket or a sand trap. As explained in the following, bell 106 must be provided with air vents 114 if the drain is directly followed by a water seal.

Figure 7:
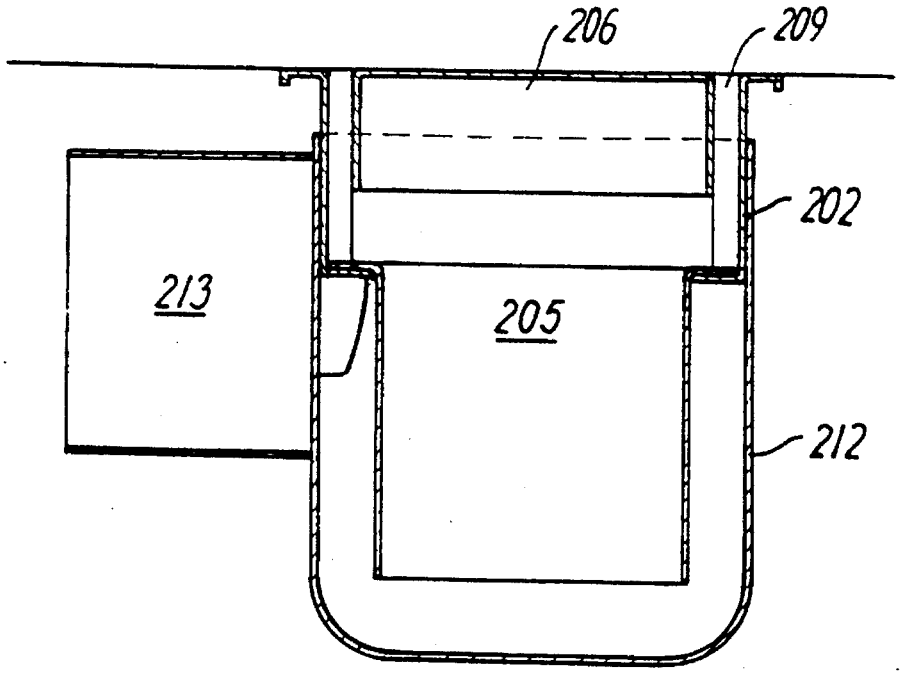
Figure 6:
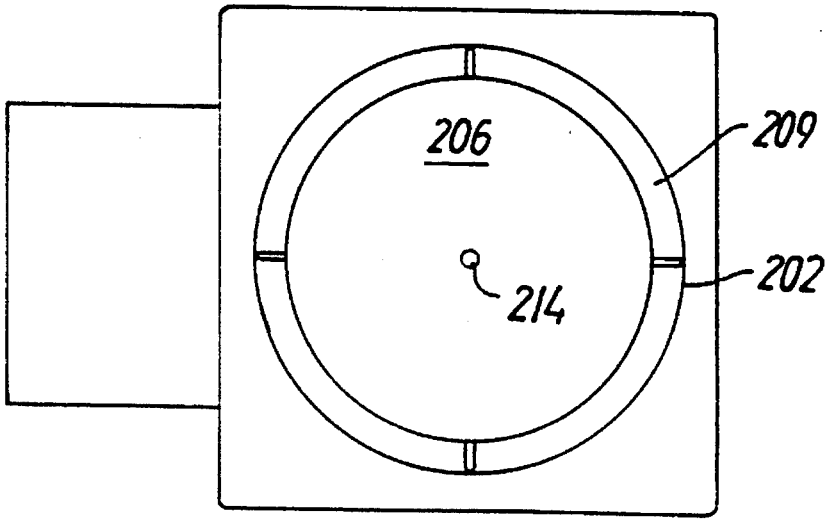

FIGS. 6 and 7 illustrate a second embodiment of the invention in which a drain with a drainage bowl 202 accommodating a bell 206 so as to form a slot 209 has an outlet 205. An outer bowl 212 encompasses outlet 205 as well as drainage bowl 202. Outlet 205 extends downwards close to the bottom of the outer bowl 212 and a drainage 213 is connected with the outer bowl 212 somewhat above the lower edge of outlet 205. A water seal is thus provided in that there will always be water in the outer bowl 212 up to the lower edge of drainage 213.

In this embodiment bell 206 must be provided with an air vent 214 in order to prevent pressure rises on the lower side of the bell when water flows through the drain and slot 209 is running to capacity which might cause damage to the suction effect of the drain.

It should be observed that drainage bowl 202 as well as outlet 205, bell 206 and the outer bowl 212 may be drawn out of sheet steel.

Figure 9:
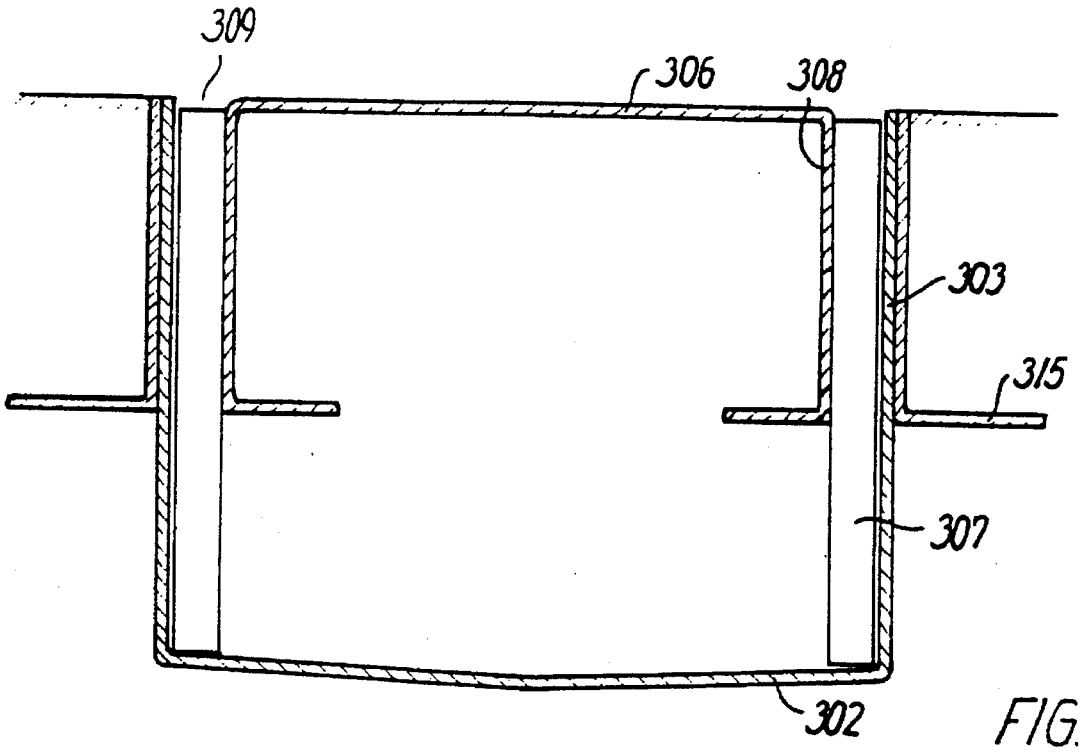
Figure 8:
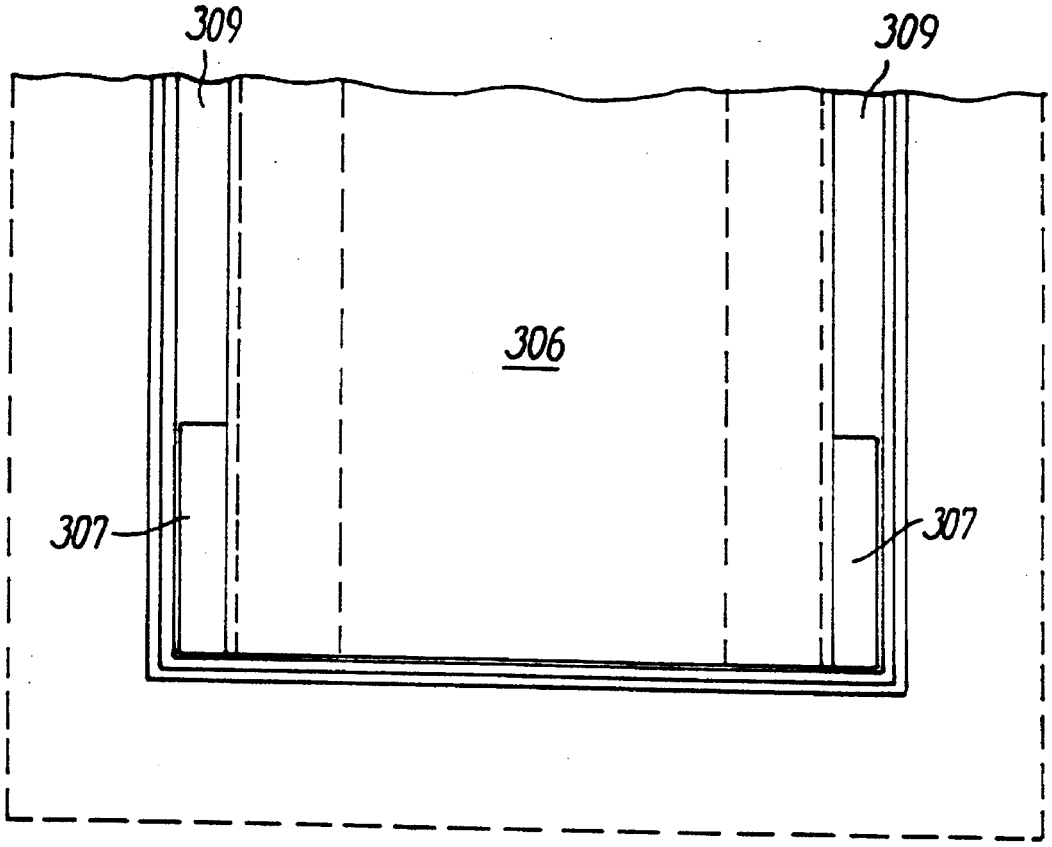

FIGS. 8 and 9 illustrate a third embodiment of the invention. This case deals with an outlet gutter 302 with vertical side walls 303 and an outlet, not shown, at the bottom of the outlet gutter 302. A longitudinal member 306 with vertical side walls 308 is embedded in the outlet gutter 302, thereby forming slots 309. Member 306 is kept in place by means of legs 307 also serving as spacers.

It is remarked that the outlet gutter 302 as well as member 306 and an embedment flange 315 may be obtained by bending stainless sheet steel.

Figure 10:
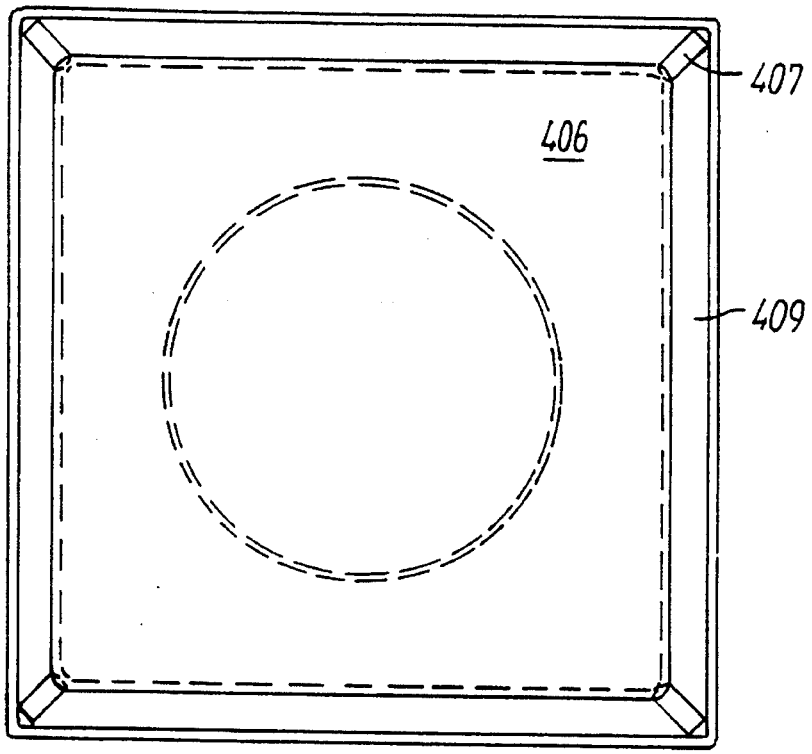
Figure 11:
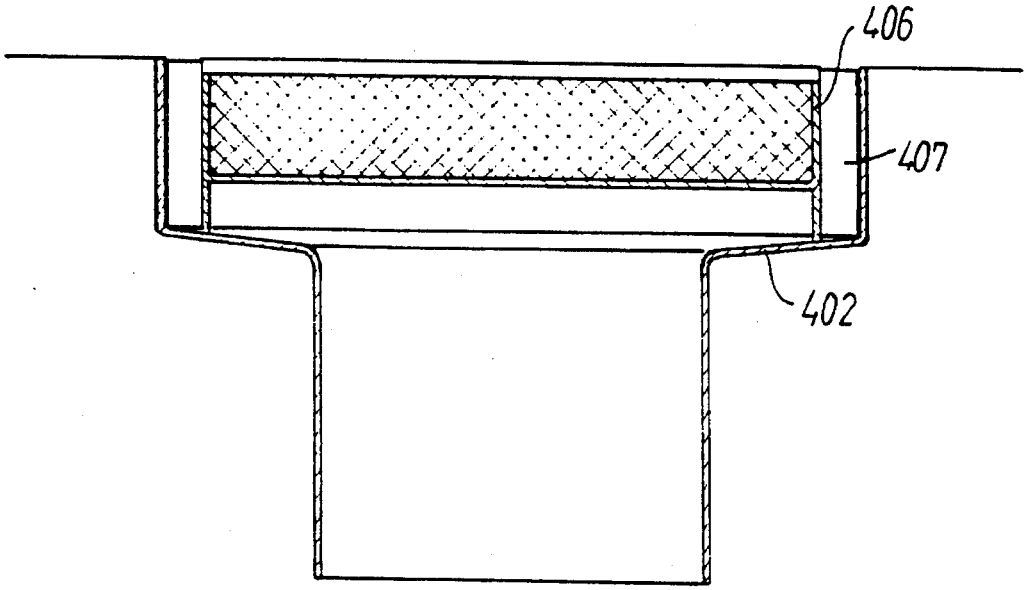

FIGS. 10 and 11 illustrate a fourth embodiment which to a certain degree corresponds to the first embodiment. However, bell 406 is drawn out of stainless sheet steel and Is kept in place in drainage bowl 402 by legs 407 welded on bell 406.

Bell 406 is turned upside-down in comparison with bell 106 of the first embodiment so as to appear as a bowl. This bowl may be filled with the same material from which the surrounding floor is made, following which a slot 409 of the drain is all that is visible of the drain.

In certain cases it is advantageous that the outer top portion of a drainage bowl is not straight but that a rabbet is provided at the outside close to the inlet opening.

Figure 12:
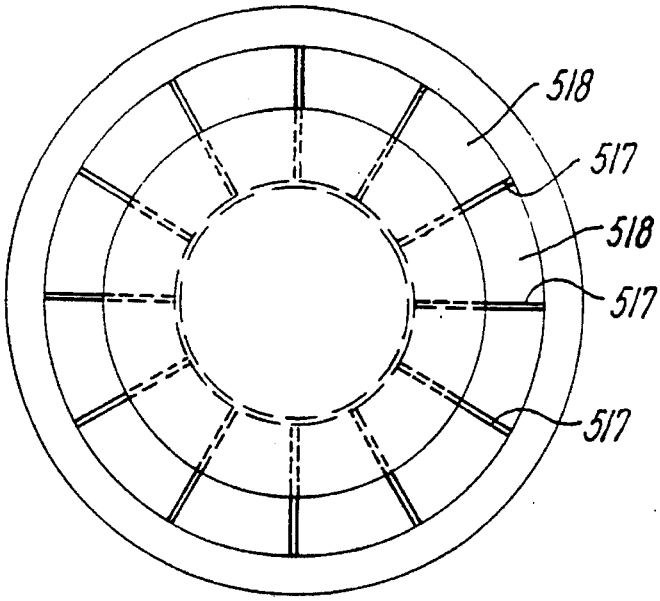
Figure 13:
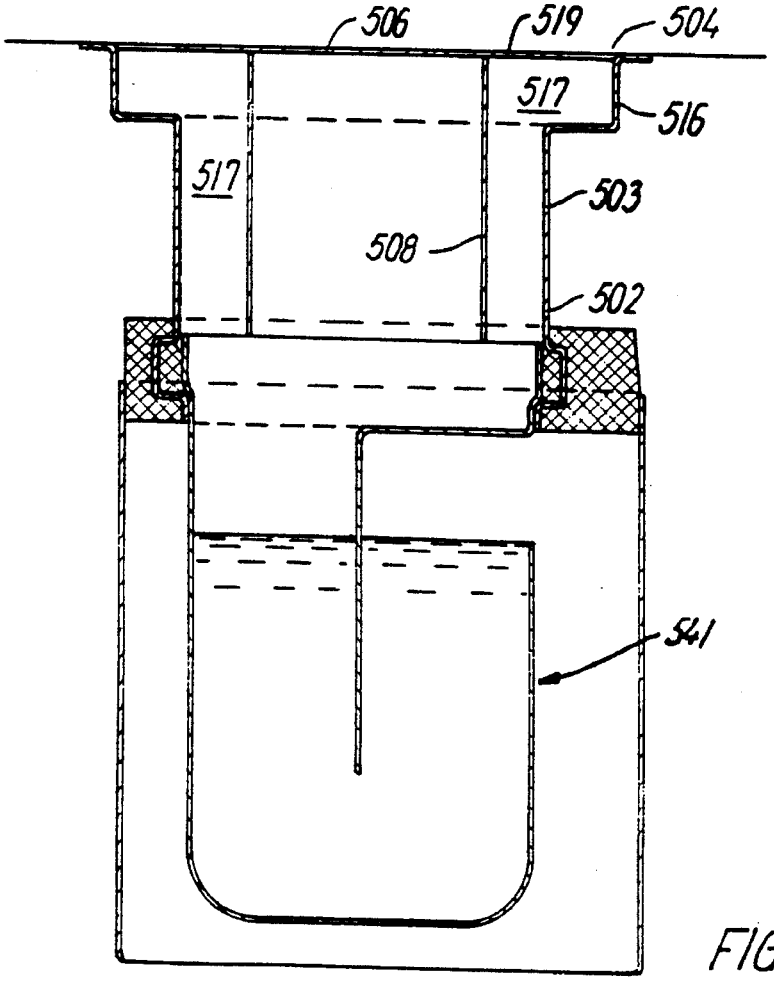

Such an embodiment is shown in FIGS. 12 and 13. A drainage bowl 502 with vertical side walls 503 has a circumferential rabbet 516 at the inlet opening 504. A member 506 with vertical side walls 508 is inserted in the drainage bowl 502. Moreover, member 506 includes radial tongues 517 extending between the vertical side walls 508 and 503 and likewise extending to the inlet opening 504. The slot between the vertical side walls 503 and 508 is thus divided into passageways 518. Member 506 has a top part 519 extending from the vertical side wall 508 and as far on to the periphery of inlet opening 504 that the entrance to the passageways 518 has almost the same cross-sectional area as the passageways 518 between the two vertical side walls 503 and 508, i.e. in the vertical part of the passageways where the suction effect is ensured. This ensures that the suction is effective from inlet opening 504. The drain is shown followed by a water seal 541.

Figure 14:
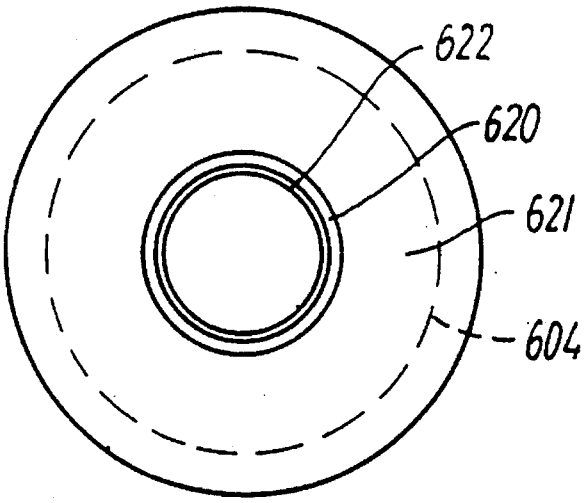
Figure 15:
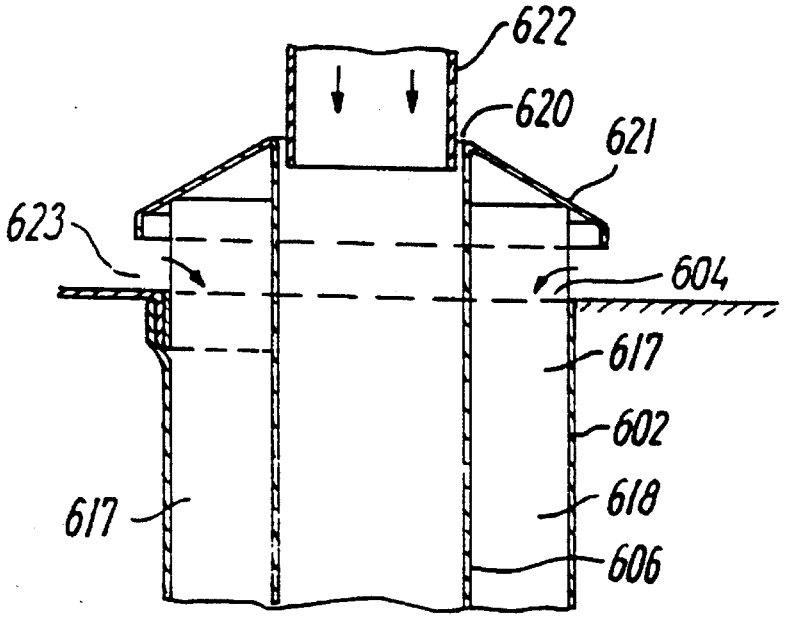

FIGS. 14 and 15 show a sixth embodiment of the invention. This embodiment includes a circular-cylindrical drainage bowl 602 and a circular-cylindrical member 606 in which vertical, radial tongues 617 are provided in the slot between drainage bowl 602 and member 606, thereby dividing the slot between the drainage bowl and the member into passageways 618. The top of member 606 has a circular opening 620 surrounded by a rosette 621 extending radially beyond the inlet opening 604 of drainage bowl 602.

With this embodiment it is possible to pass a sewage pipe 622 for instance from a sink down centrally of member 606 of the drain through opening 620. In view of the fact that only the rosette 621 and a slot 623 between the lower edge of the rosette and the floor will be seen, the rosette 621 makes the floor drain substantially invisible.

Figure 16:
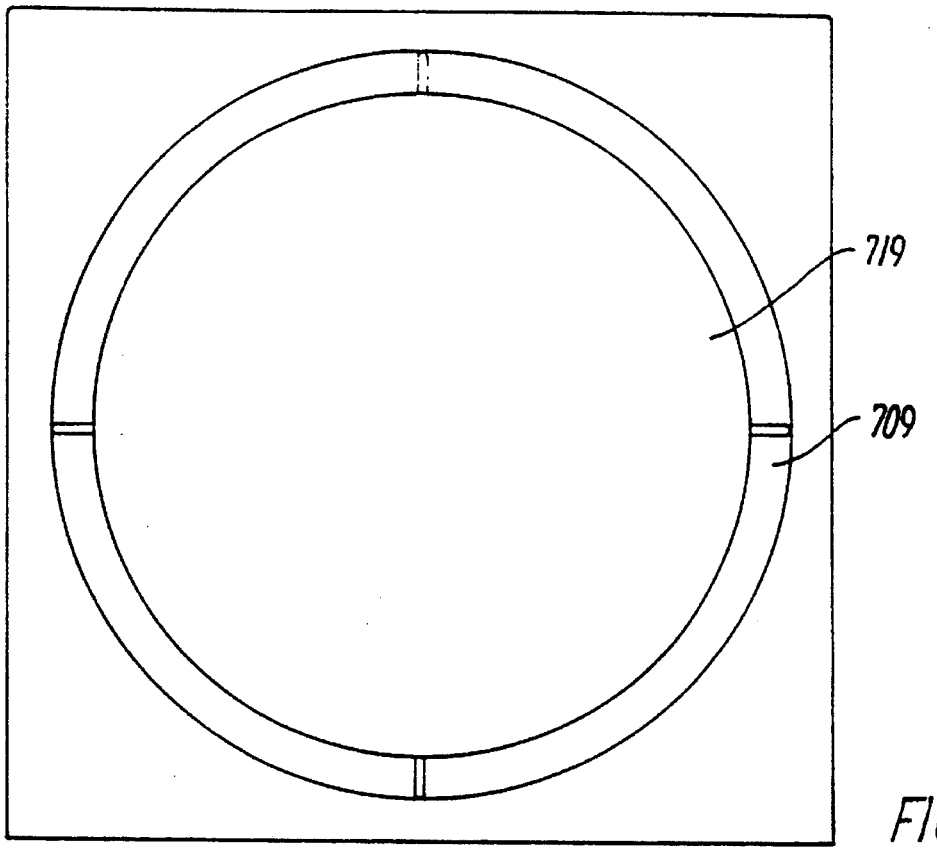
Figure 17:
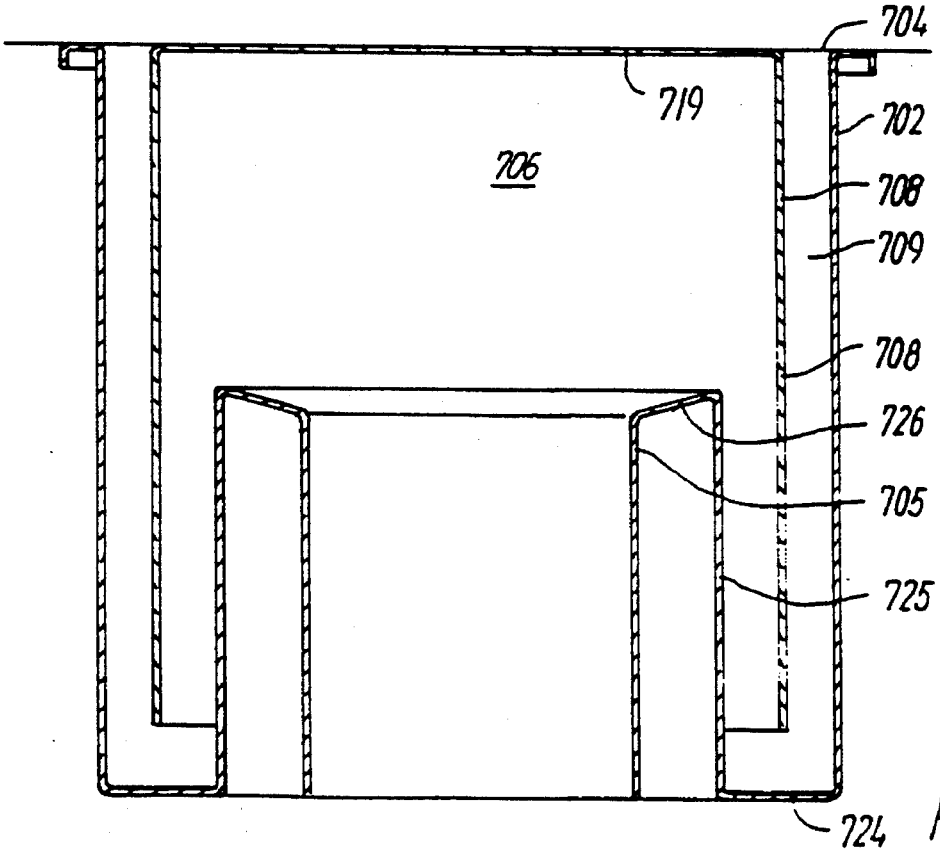

FIGS. 16 and 17 illustrate a seventh embodiment of the invention. The floor drain of this embodiment consists of a circular-cylindrical drainage bowl 702 including a plane bottom 724 from which a central circular-cylindrical elevation 725 rises. This elevation extends somewhat above the bottom 724 and communicates at its upper end through a conical spacer 726 with an outlet pipe 705. A bell 706 extends from the inlet opening 704 of drainage bowl 702 downwards to a distance below the upper end of the cylindrical elevation 725, but still at a distance above bottom 724. There will always be water in the lower section of drainage bowl 702 beneath the outlet at the upper edge of the cylindrical elevation 725, thereby providing a water seal. A slot 709 formed between a vertical side wall 703 of drainage bowl 702 and a vertical side wall 708 of bell 706 ensures the suction effect of the drain, the height difference caused by the suction constituting part of the difference between the level of inlet opening 704 of drainage bowl 702 and the level of the upper edge of the cylindrical elevation 725.

In this embodiment it is important that the top portion 719 of bell 706 is leakproof because stinking air may otherwise percolate up through outlet 705 and further through the drain.

This embodiment provides for obtaining a drain with an embedded water seal and which is connectable with pipes of a number of different diameters. The drain may thus be pushed down into a pipe whose internal diameter corresponds the external diameter of drainage bowl 702 or the external diameter of outlet pipe 705. If the cylindrical elevation 725 is extended down beneath bottom 724 the drain may further be pushed down into a pipe whose internal diameter corresponds to the external diameter of said elevation.

Figure 18:
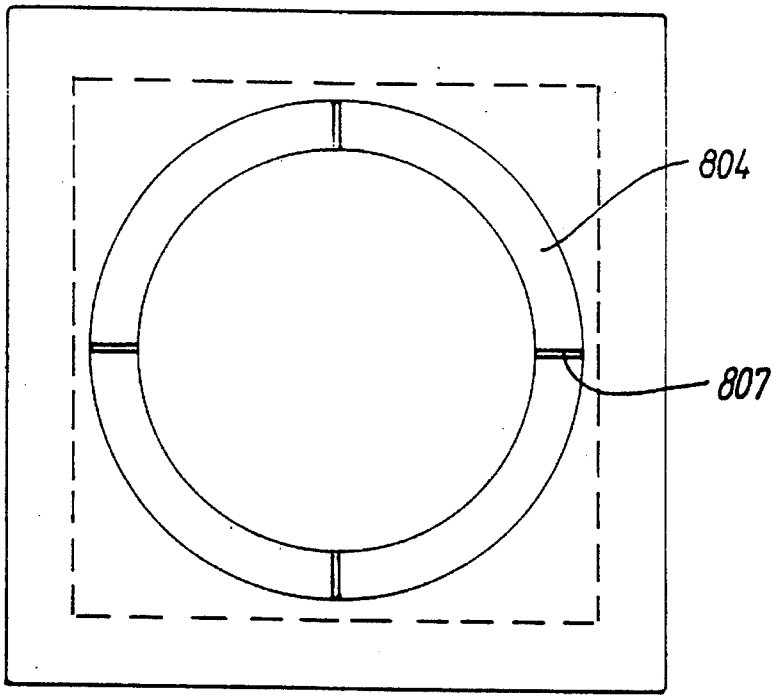
Figure 19:
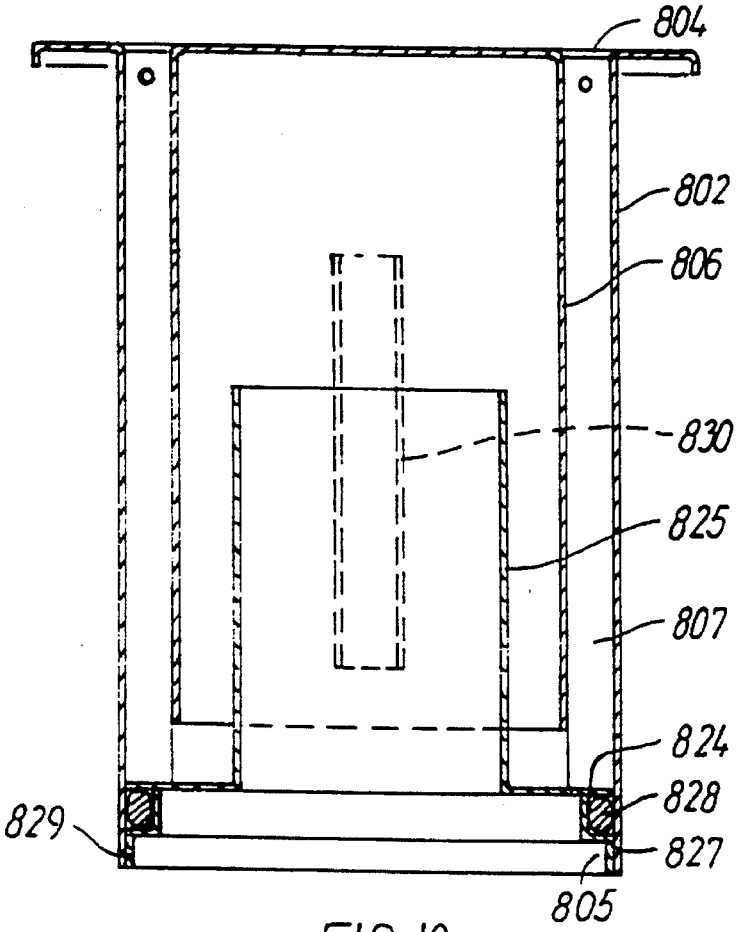

FIGS. 18 and 19 illustrate an eighth embodiment of the invention. Like the preceding embodiment this embodiment has a cylindrical drainage bowl 802 and a central-cylindrical elevation 825 extending somewhat above a bottom 824 of drainage bowl 802. In this case the bottom is, however, loose compared to drainage bowl 802. A circumferential profile member 827 is welded under the bottom. Said profile member constitutes a passageway in which an O-ring 828 is embedded. A bell 806 extends as in the preceding embodiment from the inlet opening 804 of drainage bowl 802 to a distance above bottom 824 but beneath the upper level of the central-cylindrical elevation 825. A water seal is thus provided below the top level of the cylindrical elevation 825 as in the preceding embodiment. Bell 806 is kept in place by legs or spacers 807.

The cylindrical elevation 825 and bottom 824 integral therewith are loose in relation to drainage bowl 802 and may therefore be pulled up with the view of cleaning the drain. An internal ring 829 in drainage bowl 802 constitutes a stop for bottom 824 in the downward direction. The O-ring 828 may roll over when the cylindrical elevation 825 and bottom 824 are pulled up or pushed down in place and, moreover, seals between bottom 824 and drainage bowl 802.

Due to the fact that all the insides may be removed from the drainage bowl, and outlet 805 from the drainage bowl thus has substantially the same internal diameter as drainage bowl 802 proper, the drain may be designed with substantially small dimensions without impeding the cleaning. By designing the drain dimensions small the internal diameter of the cylindrical elevation 825 becomes, however, also small and there is a risk that also this part of the drain will be running to capacity. This would, however, imply that an amount of air would be entrapped under bell 806 and above the cylindrical elevation 825. The air pressure in such an entrapped amount of air would be uncontrollable and there would be a risk that the discharge pipe of the outlet 805 running to capacity would suck the space between drainage bowl 802 and elevation 825 empty of water, resulting in that the water seal effect would not be obtained. As shown in a dot-and-dash line, a piece of tube 830 may be disposed in outlet 805 in order to ensure air flow from the sewer pipe beneath the drain to the space below bell 806 and thus atmospheric pressure under the bell.

Figure 20:
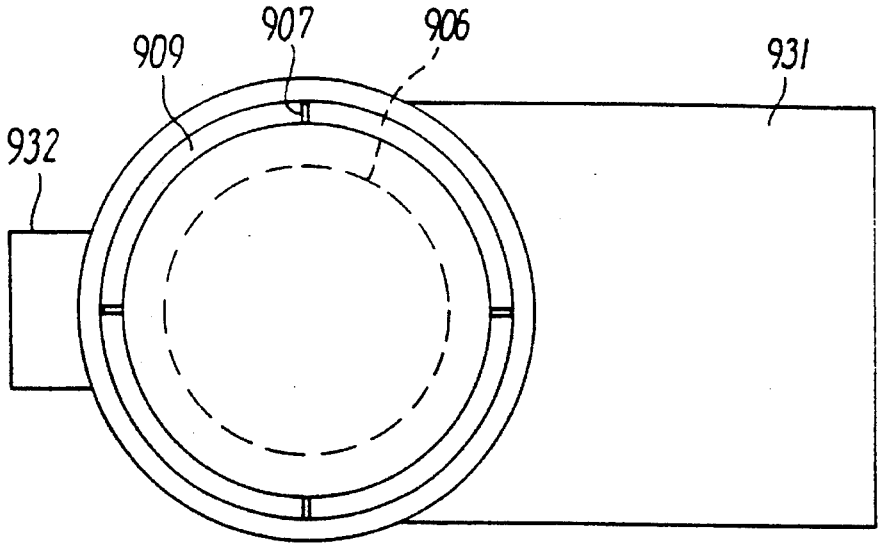
Figure 21:
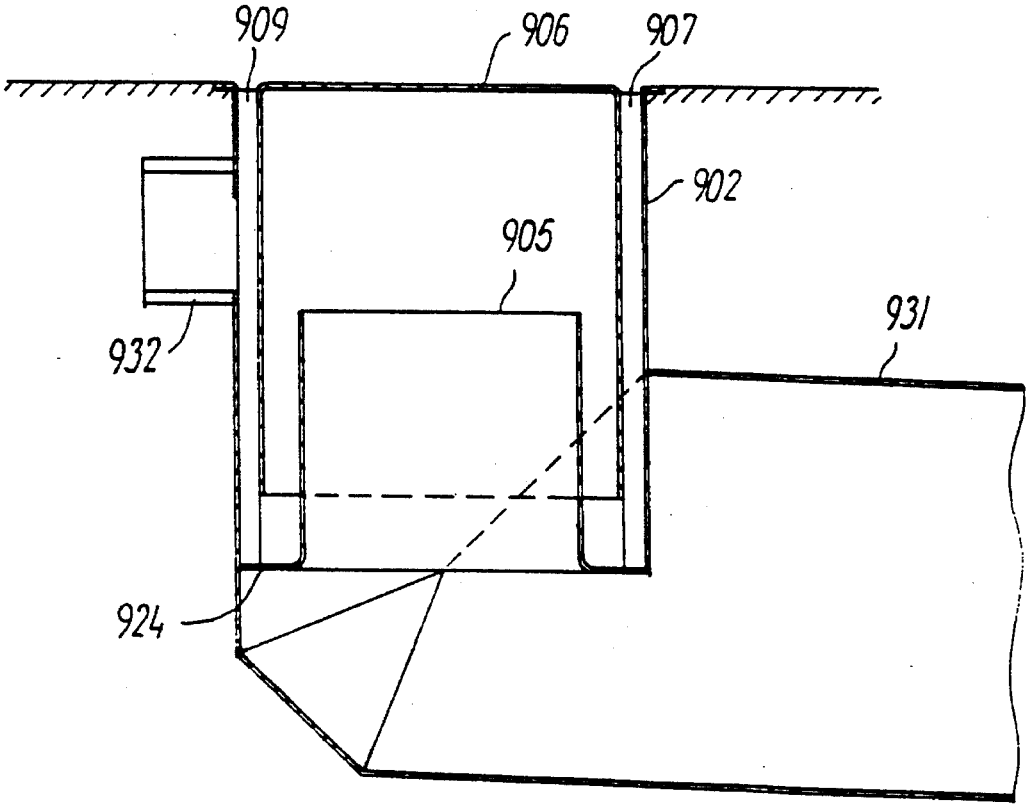

FIGS. 20 and 21 show a ninth embodiment of the invention. This embodiment includes a circular-cylindrical drainage bowl 902 with a bottom 924 and a circular-cylindrical elevation 925 including an outlet 905. Drainage bowl 902 is connected with a circular pipe 931 having a diameter corresponding to the diameter of drainage bowl 902. The two pipes are connected at an angle of a little more than 90° in such a manner that pipe 931 has a fall in the direction of the drain when the drainage bowl is vertically mounted. Drainage bowl 902 and pipe 931 are connected so that their axes intersect in the vicinity of the plane of bottom 924. As in the preceding embodiments, drainage bowl 902 accommodates a bell 906 kept in place by legs or spacers 907 so as to provide a slot 909 about member 906.

This embodiment provides for obtaining a drain with an embedded water seal and a lateral outlet and which has a very low height of installation that is frequently desirable. The illustrated embodiment is, moreover, provided with an inlet spigot 932 for a supplementary drain for instance from a shower cabin.

Figure 22:
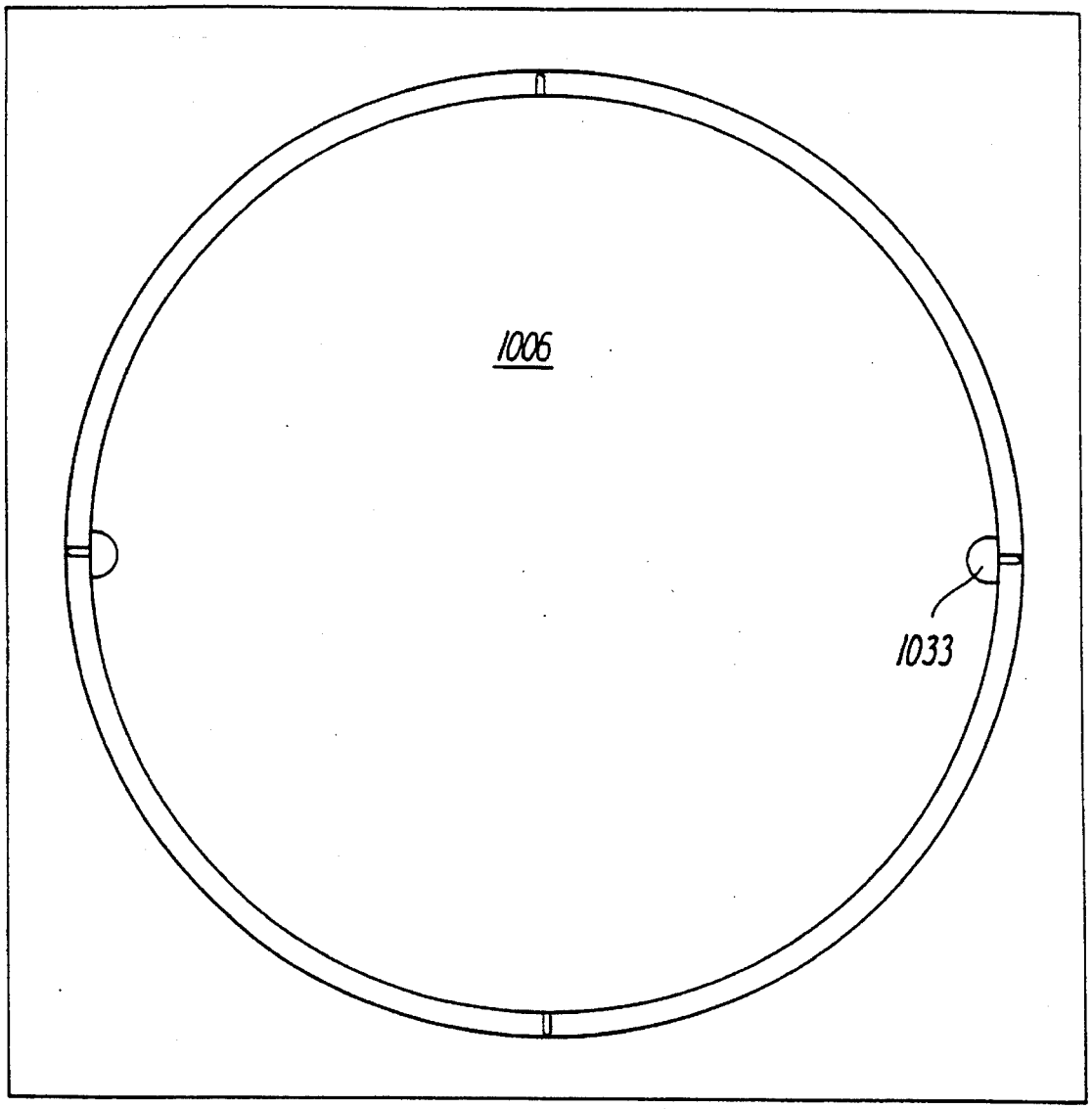
Figure 23:
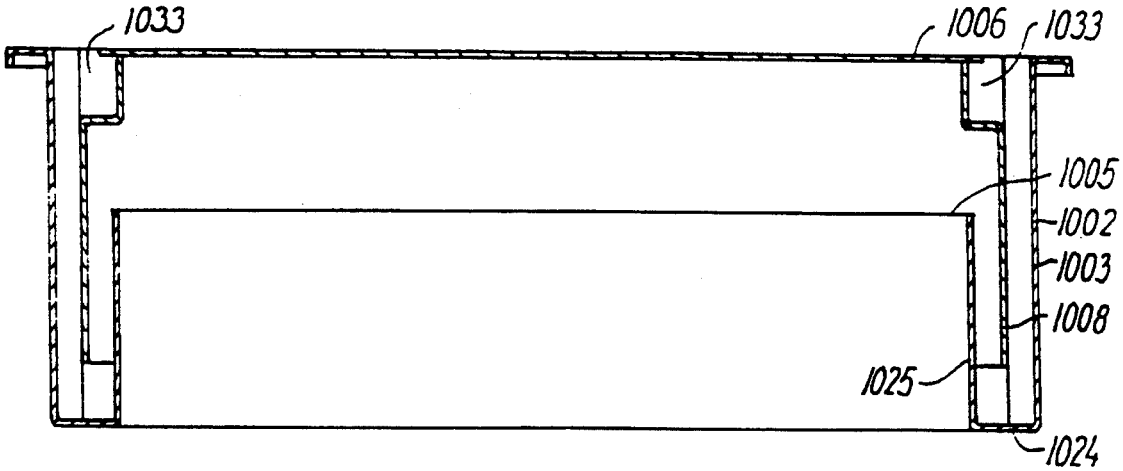

FIGS. 22 and 23 illustrate a tenth embodiment of the invention. This embodiment includes a drainage bowl 1002 with a bottom 1024 and a central-cylindrical elevation 1025 comprising the outlet 1005. A bell 1006 has a vertical side wall 1008 extending down into the space between the side wall 1003 of drainage bowl 1002 and elevation 1025. At its periphery bell 1006 has two diametrically opposite recesses 1033 adapted to be caught in order to raise bell 1006. This embodiment differs from the preceding embodiments in that outlet 1005 has a very large diameter. Outlet 1005 may thus serve as a sluice well or a pump well. In case the outlet serves as the entrance to a pump well the pump may be mounted on the lower side of bell 1006, optionally with a pump pressure spigot and an electric cable passed upwards through the bell.

Figure 24:
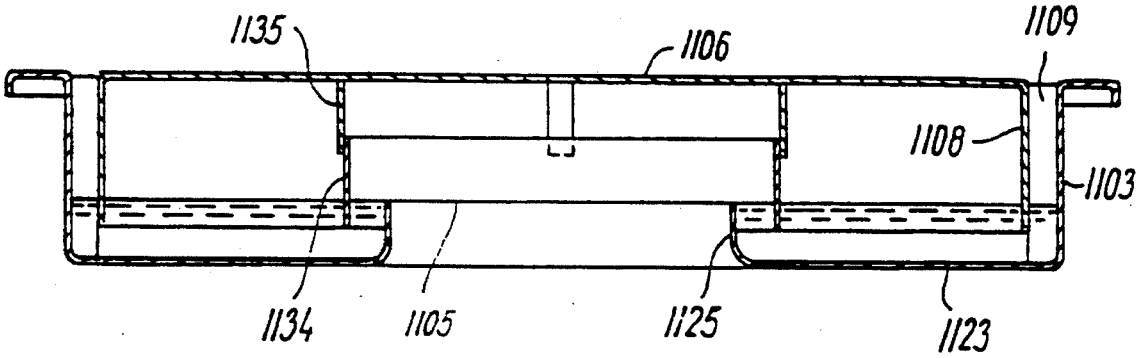
FIG. 24 is an eleventh embodiment, viewed in a vertical section, and FIGS. 25 and 26 a twelfth embodiment, viewed from above and in a vertical section, respectively.

FIG. 24 shows an eleventh embodiment of the invention. In this embodiment the drainage bowl includes a vertical side wall 1103, a bottom 1124 and central, circular-cylindrical elevation 1125 with an outlet 1105. The diameter of elevation 1125 is substantially smaller than the diameter of the side wall 1103 of the drainage bowl. A circular bell 1106 with a side wall 1108 has such a diameter that a slot 1109 is formed between the side walls 1103 and 1108. A circumferential wall 1134 extending from about the same lower level as the side edge 1108 of bell 1006 to a distance above the upper edge of the elevation is provided about elevation 1125 and which by means of stags 1135 is suspended in bell 1106 so as to allow air to flow between the upper edge of wall 1134 and the lower side of bell 1106.

This embodiment provides for obtaining a drain to be used as a vacuum valve allowing air to flow into the sewer system following the drain in case of negative pressure therein. Due to the small cross-sectional area of slot 1109 in relation to the area of the bottom 1123 only very little water will be sucked from the water seal provided in the drain in case of negative pressure in the ditch, following which air is sucked down through slot 1109 beneath the vertical side wall 1108 of bell 1106 above the circumferential wall 1134 and down through the outlet, thereby ensuring the effect of the water seal. The circumferential wall 1134 ensures a flow across bottom 1123 when water is drained away through the drain, thereby keeping the drain clean of dirt which might otherwise deposit on bottom 1123.

Figure 25:
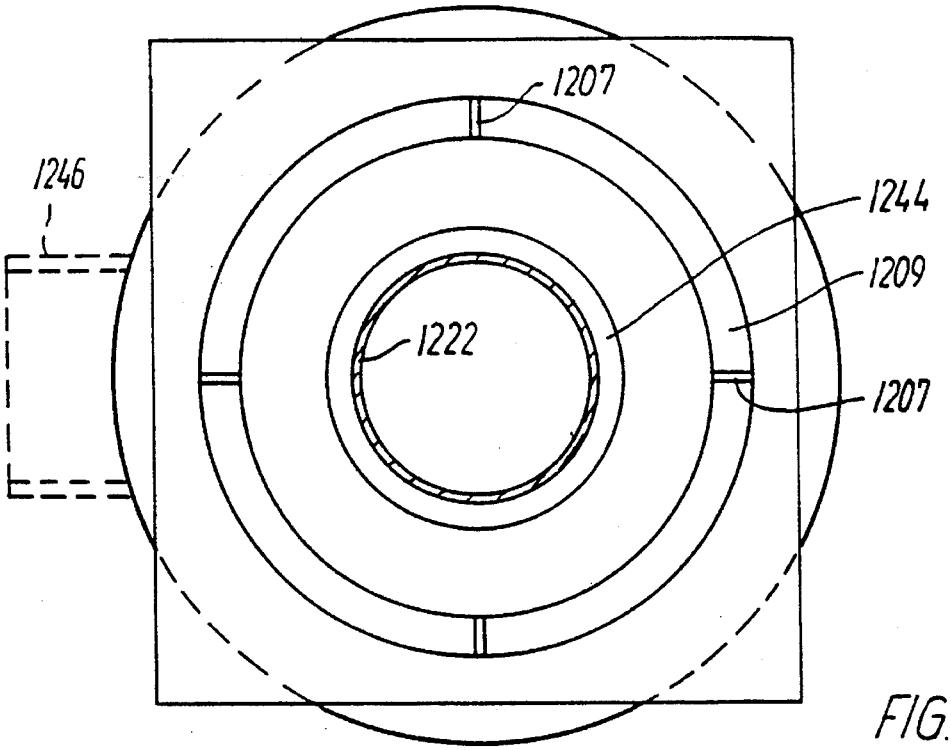
Figure 26:
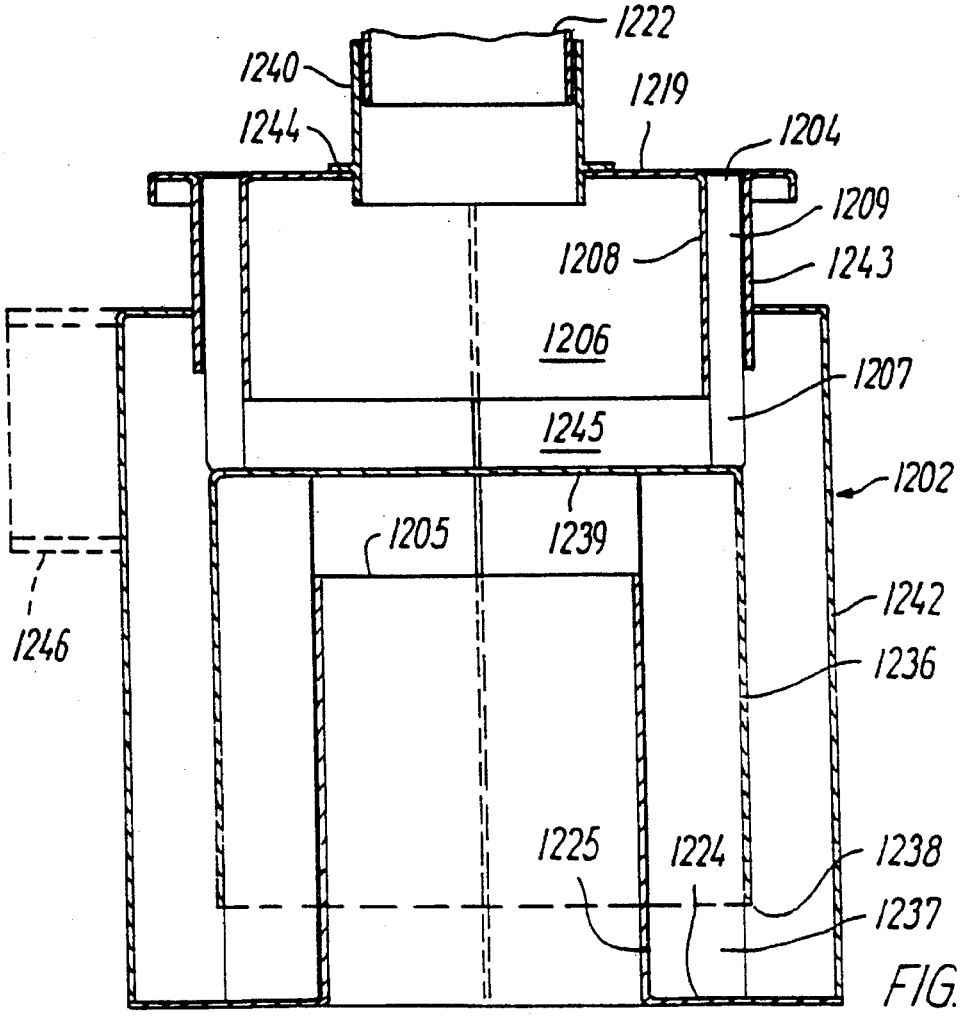

FIGS. 25 and 26 illustrate a twelfth embodiment of the invention. This embodiment includes a drainage bowl 1202 with a bottom 1224 having a central circular-cylindrical elevation 1225. The side wall of drainage bowl 1202 is divided into two sections, a first lower section 1242 and a second upper section 1243. The upper section as well as the lower section are circular-cylindrical, but the upper section 1243 has a smaller internal diameter than the lower section 1242. A cylindrical bell 1236 whose diameter is so that it may pass through the opening within the upper section 1243 of the side wall of drainage bowl 1202 and which has legs or spacers 1237 has its lower edge 1238 positioned at a distance above bottom 1224 and a top portion 1239 at a corresponding distance above the upper edge of elevation 1225 at which the outlet 1205 of the drain is positioned. Bell 1236 thereby provides a water seal in the drain.

A second bell, 1208 with a vertical side wall 1208 rests by means of legs or spacers 1207 on the first bell 1236. A slot 1209 is thus provided between the vertical side walls 1208 and 1246 of the second bell 1206 and the upper section of drainage bowl 1202, respectively. Said slot 1209 extends from the inlet opening 1204 of the drainage bowl and impart a suction effect to the drain when running to capacity.

In the top portion of bell 1206 there is a hole into which a bushing 1240 with a flange 1244 is inserted, said flange preventing the bushing from falling through the hole. A discharge pipe 1222, e.g. from a sink, may be received in bushing 1240. A slot 1245 allowing water from the discharge pipe 1222 to flow from the space beneath bell 1206 and onwards into the drain is provided between the lower edge of bell 1206 and bell 1236.

The drain of this embodiment may easily be disassembled for cleaning, bushing 1240 being lust raised, following which discharge pipe 1222 may be swung sideways. The two bells 1206 and 1236 may then be removed. As shown in dot-and-dash lines the drain may further include an inlet spigot 1246 for a supplementary drain. e.g. from a shower cabin.

A series of different embodiments of the invention has been described above and it is emphasized that further embodiments may be provided by combining in various ways features of the individually described embodiments.

I claim:

1. A floor drain comprising a drainage bowl comprising an upwardly extending side wall with a terminal edge, said terminal edge defining a floor level of the drain, said side wall having an inner side facing the inside of the drainage bowl, said drainage bowl further comprising at an outlet level below said floor level an outlet of the drainage bowl; and an internal member positioned in the drainage bowl and comprising an unperforated wall with an external side extending along and facing the inner side of the side wall of the drainage bowl, said unperforated wall having a terminal edge inside the drainage bowl below said floor level and said unperforated wall extending upwardly from said terminal edge at least to said floor level, thereby defining together with said side wall a passage between the inner side of the side wall and the external side of the unperforated wall, said passage having an inlet at said floor level defined by said unperforated wall and said terminal edge of said side wall, said terminal edge of said side wall constituting at said floor level a circumference of the inlet, and said passage further having an outlet inside the drainage bowl defined by the drainage bowl and the terminal edge of the unperforated wall, said unperforated wall and said side wall comprising above the outlet level opposite vertical portions defining between them a vertical part of the passage, said vertical part having an upper end and a lower end, and said vertical part having a cross-sectional area constituting the smallest cross-sectional area of the passage including its outlet, the cross-sectional area of the passage being substantially constant from the inlet of the passage, the inlet included, to the lower end of the vertical part, and said inlet opening and said passage constituting a slot extending substantially all along the circumference of the inlet opening.

2. A floor drain as claimed in claim 1, wherein the vertical part extends up to the inlet.

3. A floor drain as claimed in claim 1, wherein the internal member (6) is located centrally in relation to the inlet opening (4).

4. A floor drain as claimed in claim 1, wherein the side wall (103) extends from the inlet opening (104) vertically downwards and the internal member (106) is made from sheet material and has a central portion and comprise said unperforated wall (108).

5. A floor drain as claimed in claim 1, wherein the side wall (503) of the drainage bowl (502) at the inlet opening (504) has an inwards projecting shoulder (516), the vertical sections of the passage (518) extending below said shoulder (516) and the internal member (506) has an upper plane portion (519) at the floor level extending above the vertical part of the passage towards the circumference of the inlet opening, and a central portion.

6. A floor drain as claimed in claim 4, wherein the central portion has at least one continuous opening (114, 620).

7. A floor drain as claimed in claim 4, wherein the side wall (703) of the drainage bowl (702) extend to a bottom (724) which is below the terminal edge of the unperforated wall of said internal member (708) an elevation (725) being connected to said side wall (703) through said bottom and comprising the outlet of the drainage bowl; said elevation (725); said internal member (708) and said side wall (703) defining together a water seal passage.

8. A floor drain as claimed in claim 7, wherein the upwardly extending side wall of the drainage bowl (902) is constituted by a tube section united with a second similar tube section (931) at an angle of about but not less than 90° and the axes of said two tube sections intersect in the vicinity of the plane of the bottom (924).

9. A floor drain as claimed in claim 7, wherein the area of the outlet (1105) of the drainage bowl is substantially smaller that the area of the inlet opening, and spaced from the elevation (1125), a wall (1134) surrounding said elevation (1125) and extending from a lower level below the outlet level to a level about the about level, thereby providing for passage above said surrounding wall (1134).

10. A floor drain as claimed in claim 1, wherein the internal member (606) extends upwards above the floor level, said member (606) has a vertical continuous opening (620) on the opposite side of the unperforated wall in relation to said passage, and the internal member has a top portion (621) extending above the floor level.

11. A floor drain as claimed in claim 1, wherein the passage is divided by vertical partitions (517).

12. A floor drain as claimed in claim 1, wherein the drainage bowl is elongated thereby constituting an outlet gutter (302).

* * * * *